US006953374B1

(12) United States Patent
Connolly

(10) Patent No.: US 6,953,374 B1
(45) Date of Patent: Oct. 11, 2005

(54) MAN OVERBOARD RETRIEVAL DEVICE

(76) Inventor: John Patrick Connolly, P.O. Box 163, Sausalito, CA (US) 94966

( * ) Notice: Subject to any disclaimer, the term of this patent is extended or adjusted under 35 U.S.C. 154(b) by 0 days.

(21) Appl. No.: 10/767,354

(22) Filed: Jan. 28, 2004

Related U.S. Application Data

(60) Provisional application No. 60/443,497, filed on Jan. 29, 2003.

(51) Int. Cl.[7] ..... B63C 9/00

(52) U.S. Cl. ..... 441/80; 43/13

(58) Field of Search ..... 441/80, 84, 87, 441/88; 43/13

(56) References Cited

U.S. PATENT DOCUMENTS

| | | | | |
|---|---|---|---|---|
| 3,228,044 A * | 1/1966 | Mattenson | ..... | 441/83 |
| 4,599,073 A | 7/1986 | Fryer et al. | | |
| 4,599,074 A | 7/1986 | Beckly | | |
| 4,678,446 A * | 7/1987 | Dahan | ..... | 441/80 |
| 5,779,511 A | 7/1998 | Davidson, Jr. | | |

FOREIGN PATENT DOCUMENTS

| | | | | |
|---|---|---|---|---|
| DE | 3346726 A1 * | 7/1985 | ..... | B63C 9/26 |

* cited by examiner

*Primary Examiner*—Jesus D. Sotelo
(74) *Attorney, Agent, or Firm*—Bernhard Kreten; Weintraub Genshlea Chediak

(57) ABSTRACT

A man overboard retrieval device where a frame supports a net and rollers. The frame is secured to a handle. The frame includes a hinged arm.

6 Claims, 3 Drawing Sheets

MAN OVERBOARD RETRIEVAL DEVICE

This application claims the benefit of the filing date of provisional application Ser. No. 60/443,497 "Man Overboard Retrieval Device", filed Jan. 29, 2003.

FIELD OF THE INVENTION

The following invention relates generally to life saving devices at sea.

BACKGROUND OF THE INVENTION

The following reflects a device which can be quickly deployed from a fashioned storage encasement that is fastened to the deck of a ship, especially a sailing vessel in the event of a overboard mishap.

The device is designed primarily to allow one person to retrieve an unconscious person from the water without having to leave the deck of a boat.

The need to provide a mechanism for retrieving an individual who has fallen overboard or an individual found in the water requiring help and for putting that person on board a vessel has long been known to the sailing community. With this problem in mind comes the need to hoist the individual above the freeboard of a vessel which often times may involve hoisting the individual several feet above the water line.

In the past, it was known to use a tri-sail, such as a genoa sail, to do such a task with sailing vessels. One would release the halyard so that the head of the sail could be dipped into the water and pick up could be made. The individual who was being picked up could be placed within the partially submerged sail and hoisted above board. Problems with this method existed and the method could not be relied on. First, the operation involved use of a sail. The material of a sail did not permit the free flow of water. When the sail was placed in the water for the purpose of catching a person overboard in a net-like manner, the sail could not easily move through the water. Also the handler was forced to move the weight of the water which was being pushed and absorbed by the sail in addition to the weight of the person being hoisted if the capture was even possible.

Additionally, this procedure did not lend itself to quick deployment while the vessel was enroute to the person in need because the sail was usually needed to propel the boat.

The following prior art reflects the state of the art of which applicant is aware and is included herewith to discharge applicant's acknowledged duty to disclose relevant prior art. It is stipulated, however, that none of these references teach singly nor render obvious when considered in any conceivable combination the nexus of the instant invention as disclosed in greater detail hereinafter and as particularly claimed.

| PATENT NO. | ISSUE DATE | INVENTOR |
|---|---|---|
| 4,599,073 | July 8, 1986 | Fryer, et al. |
| 4,599,074 | July 8, 1986 | Beckly |
| 5,779,511 | July 14, 1998 | Davidson, Jr. |

The other prior art listed above but not specifically described teach other devices for man overboard retrieval and further catalog the prior art of which the applicant is aware. These references diverge even more starkly from the references specifically distinguished above.

SUMMARY OF THE INVENTION

The retrieval rescue device has a tubular frame shaped with a horizontal upper bar, two descending side bars that are hinged just forward of upward curving bars then both bend into a forward horizontal bar. There are two parallel horizontal tubes attached to the two descending bars to provide stiffening for the rear body and a frame for two double-edged wheels. The two hinges allow the forward horizontal bar to fold back into the rear to allow for compact stowage. A net is attached all around the frame to droop under the device to aid in holding the body. The scoop itself has a locking mechanism that keeps the fold out section locked in place for ease of body retrieval.

Once a body is securely maneuvered into the scoop, the line attached to the scoop is reeled in on a winch from the deck pulling the body up above the free board. A second line is then attached to the scoop, a block and tackle which is secured to a center pull-point loop on the frame and clipped to a harness that is wrapped around the boom that now bears the weight of the body. The handle of the scoop is now detached and placed on the deck while the body is able to freely swing over the top of the boat and down onto the deck.

The device is designed primarily to allow one person to retrieve an unconscious person from the water without having to leave the deck of a boat. It has a tubular frame shaped with a horizontal upper bar, two descending side bars that are hinged just forward of upward curving bars then both bend into a forward horizontal bar. There are two parallel horizontal tubes attached to the two descending bars to provide stiffening for the rear body and a frame for two double-edged wheels. The two hinges allow the forward horizontal bar to fold back into the rear body to allow for compact stowage. A net is attached all around the frame to droop under the device to aid in holding the body. A collapsible handle is attached to the upper portion of the rear frame assembly.

A commercial version of this device is a more robust yet similar design to the described life scoop. However, the purpose is the same. It is designed to be used by larger boats and ships that either carry passengers or a working crew. It is of a rectangular shape with two rear bars that incorporate two wheels; there are two under support struts. This frame will be constructed with tubular material. There will be a net connected to and hanging down from the rectangular frame. A sectioned metal handle will be attached to the frame. This complete unit can be used by a person aboard the vessel to retrieve a person that has fallen into the water. Consequently, the rescuer does not have to leave the deck of the boat. The retrieval can be done for a conscious and alert person or for one who has either lost consciousness or has lost their mental or physical faculties.

OBJECTS OF THE INVENTION

Viewed from a first vantage point, it is an object of the present invention to provide a man overboard retrieval device comprising, in combination, a handle, a frame attached to the handle and a net attached to the frame.

These and other objects will be made manifest when considering the following detailed specification when taken in conjunction with the appended drawing figures.

DESCRIPTION OF PREFERRED EMBODIMENTS

Figure 1:
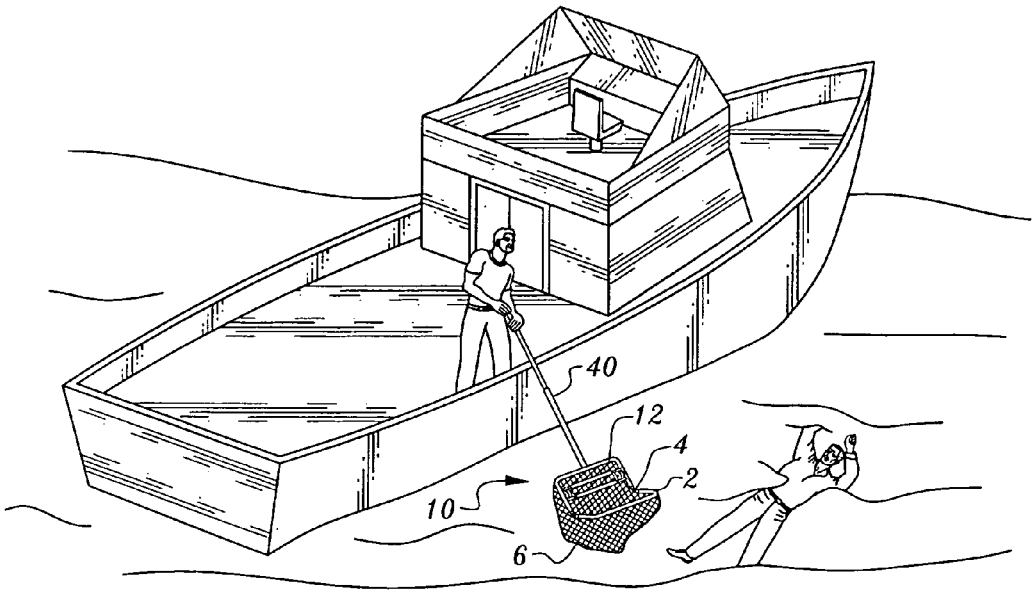
FIG. 1 is a perspective view of the device of the present invention.

Considering the drawings, wherein like reference numerals denote like parts throughout the various drawing figures, reference numeral 10 is directed to the life saving device according to the present invention.

In its essence, the device 10 includes a frame having a front U shaped portion 2 attached to a rear U shaped portion 12 at two hinges 4. The two U shaped portions define a clam shell type opening and closing structure. Netting 6 on the frame's two U shaped portions capture the overboard person.

The rear U shaped portion 12 includes a somewhat linear bight bar 14 and two curved "C" shaped legs 16. Free ends of the legs hinge to legs 26 of the front U shaped portion 2. When closed, the bight 24 of the front U approaches the bight 14 of the rear U shaped portion.

Rear U shaped portion 12 includes two struts 32 extending between legs 16. Struts 32, legs 16 and two bars 36 between struts 32 support wheels 34. Wheels 34 can ride on the boat hull during rescue.

Figure 5B:
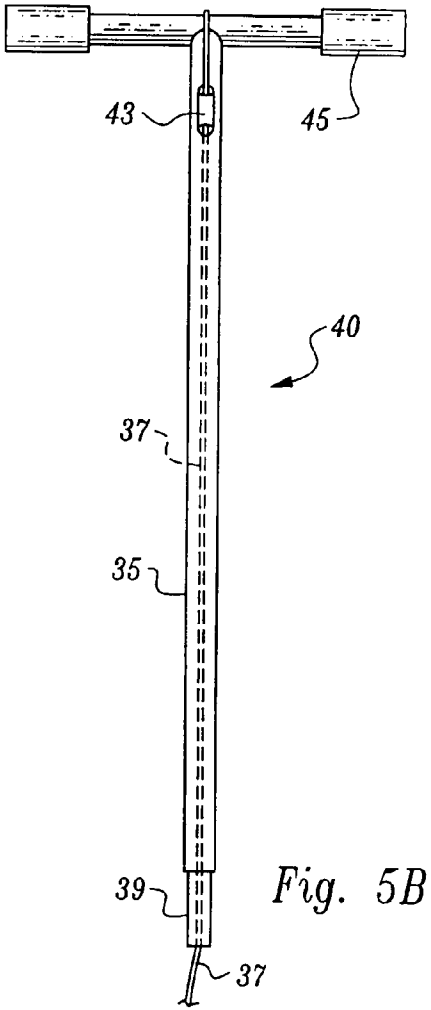
FIG. 5B is a second view of the handle.
Figure 5A:
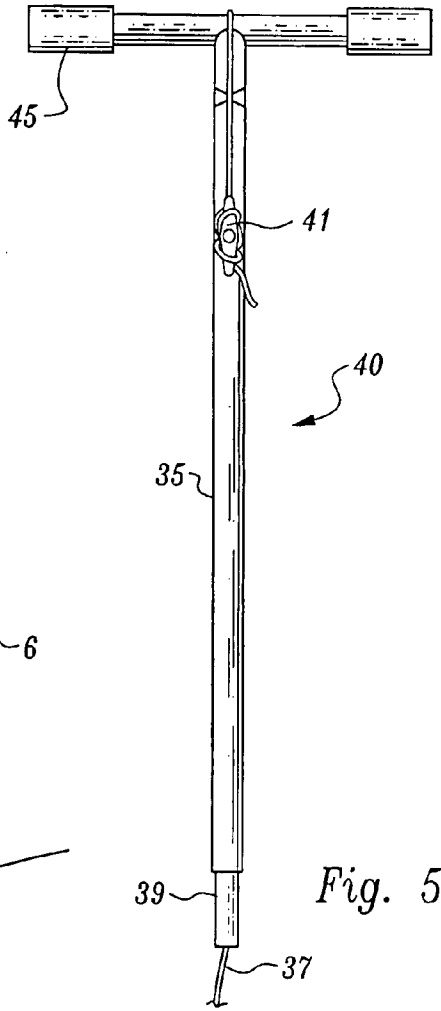
FIG. 5A is a view of the handle on one side.

Handle 40 may be telescopic (e.g., FIGS. 1 through 3) or segmented (FIGS. 5A, B) having plural sections 35, 39, etc., constrained by friction and taking slack from line 37 tied onto the frame at one end and fixed at a free end of the handle adjacent cross arm 45 by a cleat 41 lead to an interior of the handle by a pulley 43.

Figure 2A:
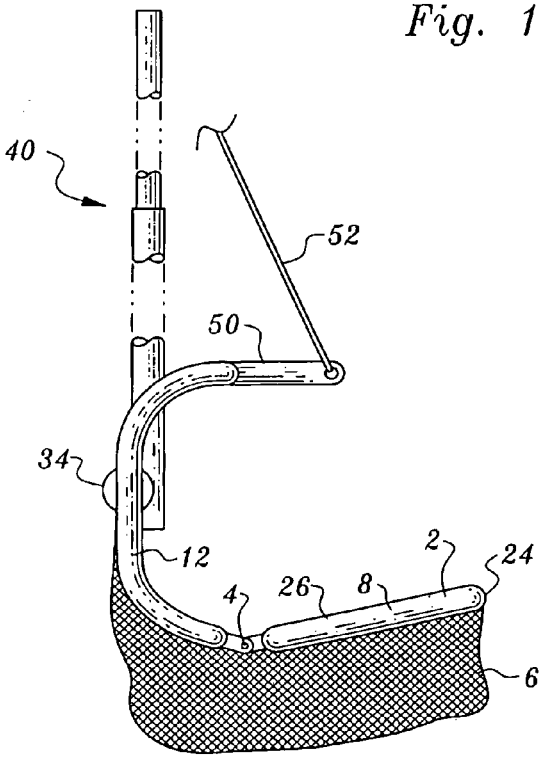
FIG. 2A is a side view.

FIG. 2A shows a feature where a projection 50 is oriented on the rear frame, preferably on bight 14. Projection 50 leads to a line 52 which can be to the ship for hoisting.

FIG. 1 is a perspective view illustrating a typical overboard rescue utilizing the fully deployed scoop device. It depicts a single person maneuvering the device in order to pull an individual out of the water.

FIG. 2A is a side view showing the open hinged area with netting 6 providing the bed of the scoop. The dual hinges 4 allow for easy and compact storage of the device when folded in on itself. When deployed, a locking mechanism is pushed into place that keeps the bed of the scoop open so as not to fold back up once the device is put into the water. Protective flotation material 8 around the scoop bed tends to push the hinged arm of the scoop up and back on to itself which must be maintained for ease of rescue. The frame of the scoop is tubular and flotation material 8 is used around the netted bed tubing to keep the device afloat during the maneuvering of the device under the person in the water. The top arm of the frame has a projection 50 that extends over the netted bed of the device and has a fabricated loop 52 and deck line attached. This line attached to the loop in the extended frame over the netted bed of the scoop is designed at a particular angle so as to provide a pull point which gives the individual on deck a clear alignment in order to pull the person out of the water by using an onboard winch.

Figure 2B:
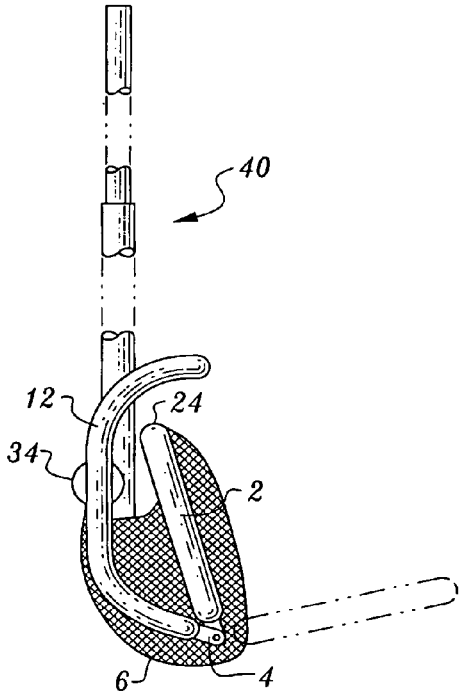
FIG. 2B is a side view.

FIG. 2B is a side view of the working apparatus of the scoop bed folded back on itself and in a deployed position.

Figure 3:
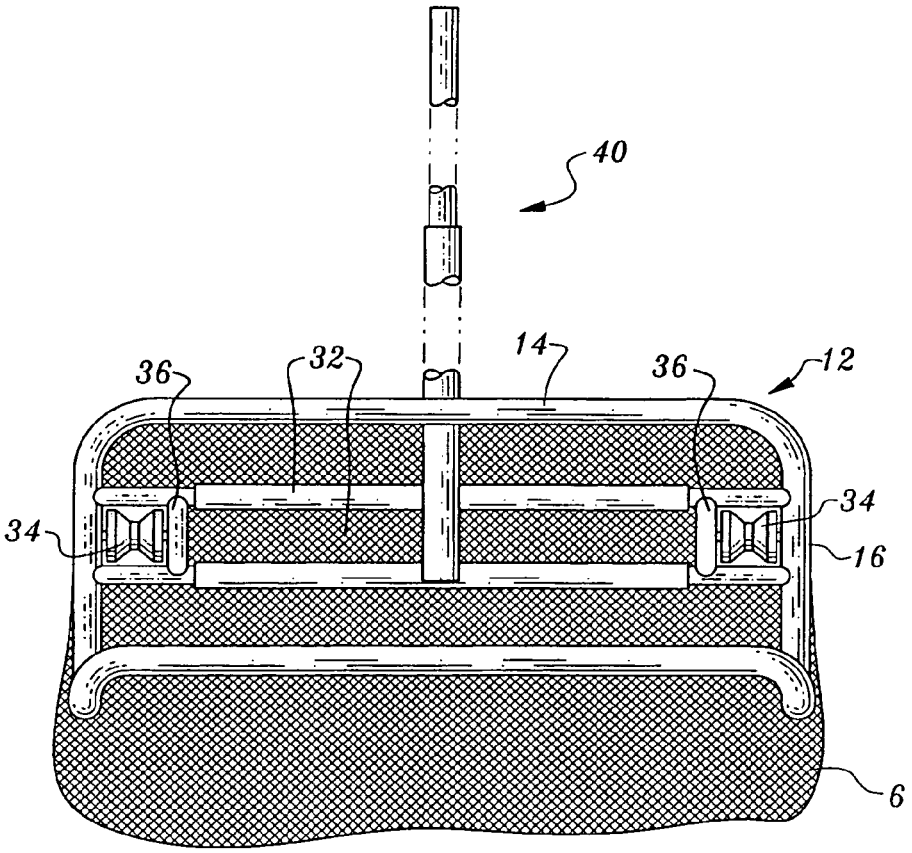
FIG. 3 is a front view.

FIG. 3 is front view of the scoop showing the drooped netting of the bed and the detail of the wheel carriage that allows the device to be rolled up the side of a vessel. The handle is fabricated in four sections and is held together by a line that travels through the center of each section and is attached to the base of the scoop bed and tied off at the top of the handle, locking the handle sections in place.

Figure 4A:
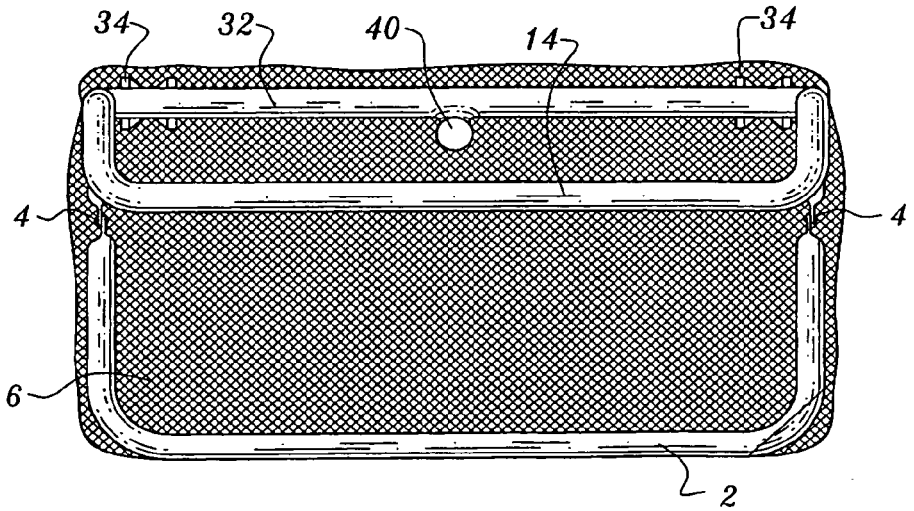
FIG. 4 is a top view.
Figure 4B:
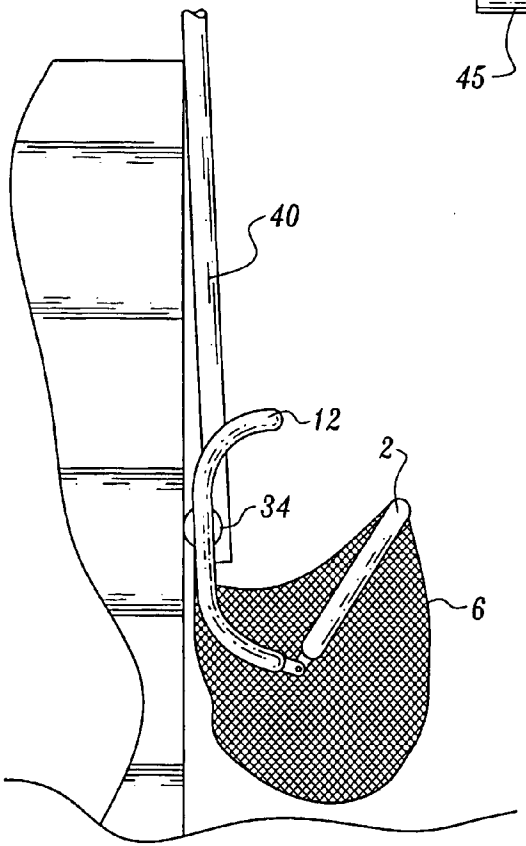

FIG. 4 shows the top view of the scoop bed and the handle holder in the center of the wheel carriage as well as a side view showing the wheels extended over the frame. Once the person in the water has been maneuvered into the scoop and picked up out of the water, the extended wheels allow the device to be easily pulled up the side of the hull and lifted on to the deck.

Moreover, having thus described the invention, it should be apparent that numerous structural modifications and adaptations may be resorted to without departing from the scope and fair meaning of the instant invention as set forth hereinabove and as described hereinbelow by the claims.

I claim:

1. A crew member overboard retrieval device which reboards the crew member on a boat, comprising, in combination:

a handle;

a frame attached to said handle;

a net attached to said frame; and a support wheel means operatively coupled to said frame to allow said device to roll on a hull of the boat, facilitating retrieval.

2. The device of claim 1 wherein said frame includes front and rear U-shaped portions interconnected by hinge means.

3. The device of claim 2 wherein said rear U-shaped portion includes legs interconnected by a pair of spaced parallel struts, said struts interconnected by a pair of spaced, parallel bars, said bars and said legs supporting support wheels.

4. The device of claim 3 including a projection on said frame, said projection connected to a line for hoisting said device.

5. The device of claim 3 wherein said handle is telescopic.

6. The device of claim 3 wherein said handle is formed from segmented plural interconnecting sections.

* * * * *